US006530151B2

(12) United States Patent
Kameka

(10) Patent No.: US 6,530,151 B2
(45) Date of Patent: Mar. 11, 2003

(54) SHAVING ARTICLE FOR CURVED AND SENSITIVE BODY SURFACES

(76) Inventor: Debra A. Kameka, 5397 Orange Dr. Suite 202, Davie, FL (US) 33314

( * ) Notice: Subject to any disclaimer, the term of this patent is extended or adjusted under 35 U.S.C. 154(b) by 0 days.

(21) Appl. No.: 09/759,674

(22) Filed: Jan. 16, 2001

(65) Prior Publication Data

US 2002/0092175 A1 Jul. 18, 2002

Related U.S. Application Data

(60) Provisional application No. 60/236,339, filed on Sep. 29, 2000.

(51) Int. Cl.[7] ..... B26B 21/02; B26B 21/56
(52) U.S. Cl. ..... 30/49
(58) Field of Search ..... 30/34.1, 50, 526, 30/49

(56) References Cited

U.S. PATENT DOCUMENTS 2,264,323 A * 12/1941 Monnet ..... 30/526
4,926,553 A * 5/1990 Miskin et al. ..... 30/49
4,989,328 A * 2/1991 Sokoloff ..... 30/34.1
6,052,905 A * 4/2000 Branchinelli et al. ..... 30/34.1

OTHER PUBLICATIONS

Photocopies of Gillette Sensor razor purchased by the Examiner prior to 1994.*

* cited by examiner

*Primary Examiner*—Douglas D. Watts
(74) *Attorney, Agent, or Firm*—M. K. Silverman

(57) ABSTRACT

A shaving article for sensitive surfaces and curved body areas includes an elongate handle having one free end and an opposite end from which a shank or neck portion integrally depends, the shank and handle defining an aggregate effective lever arm. The article includes a shaving head assembly transversely dependent from the neck portion, the assembly having a blade housing including means for holding and positioning of a blade having a length in a range of about 17 to about 23 millimeters, the blade defining a rotated arm of the lever arm in which a ratio of length of the lever arm to the rotated arm defines a range of between about 3.5:1 to about 5.5:1. The preferred length of the blade, within said range, is about 20 millimeters (0.75 inches). The mass or weight of the handle typically exceeds the aggregate mass or weight of the shank and shaving head assembly thereby moving the center of gravity of the article closer to the center of the fingers of the user so that the article may be more easily controlled.

13 Claims, 5 Drawing Sheets

SHAVING ARTICLE FOR CURVED AND SENSITIVE BODY SURFACES

REFERENCE TO RELATED APPLICATION

This application claims the benefit under 35 U.S.C. 119(e) of Provisional Application No. 60/236,339. filed Sep. 29, 2000, and the same is incorporated by reference.

BACKGROUND OF THE INVENTION

1. Area of Invention

The invention relates to shaving razors and, particularly, to razor blade systems which are disposable and adapted for use with sensitive surfaces and curved areas of the body.

2. Prior Art

Shaving systems inclusive of metallic razor blades have, in one for or another, been known for over 200 years. However, in more recent times, the razor portion of the shaving system has been separated from the handle and head assembly thereof to provide the well known disposable safety razor blade which, after use, is replaced by a new razor or cutting element. Such system became prevalent by 1950 and continued to be sold until at least 1980. This technology is represented by U.S. Pat. No. 3,600,804 (1971) to Brown, entitled Safety Razor. However, by the 1980s, the concept of a disposable cartridge razor appeared which provided a number of advantages of safety, cost and effectiveness over predecessor systems. Today cartridge razor blade systems are universally known. Therewith, the concept of an entirely disposable razor system has competed with cartridge systems since about 1990.

Notwithstanding improvements in the mounting of razor elements, both in cartridge and disposable systems, in areas such as angulation of the blade to improve closeness of the shave and so-called guard bars or strips to provide skin lubrication and reduce nicks and cuts caused by the longitudinal edge of the blade, certain shaving needs of the public have nonetheless remained less than fully addressed by state-of-the-art shaving systems. These areas, more particularly, have included a suitable razor for the shaping of beards, mustaches and sideburns and, with respect to the needs of many women, a razor capable of accessing sensitive, typically curved body recesses and areas.

The problems associated with the shaving of such narrow and curved body areas and recesses are two-fold, the first being that of achieving adequate contact with such a curved, typically concave, body surface. Clearly, no razor can function in a contemplated fashion if the linear cutting edge of the blade element cannot be brought into effective contact with the body surface. Therein, the longer or greater the dimension of the cutting edge of the razor blade, the more difficult it is to accomplish such effective contact between the blade and the body surface. The second problem associated with the shaving of such small dimension, sensitive, curved body areas as, typically, is the case in bikini line and underarm shaving requirements is that even where a blade of normal length, e.g., 40 millimeters (1.5 inches) can be brought into suitable contact with the body surface to be shaved, an elevated risk of nicking or cutting exists due to the fact that a small, often inadvertent, transverse or tilt of angulation of the handle of the blade can result in a sufficient rotation of the ends of the blade to cause a serious nick or cut upon a sensitive area of the body, this as is more fully explained below.

The prior art has, to the knowledge of the within inventor, addressed the above only through the use of blade guards and the suggested use of a curved blade conformed to the anatomical surface of interest. Such curved blade systems have, however, given rise to problems of engineering, production, cost, and complexity in use. Accordingly, no curved blade system suggested in the prior art has, to the knowledge of the inventor, proven successful in the marketplace.

The present invention therefore addresses the long felt need in the art for a shaving razor system capable of safely shaving sensitive surfaces and narrow curved body areas in the context of a system that can be cost-effectively manufactured and conveniently used by the mass market.

SUMMARY OF THE INVENTION

A shaving article for sensitive surfaces and curved body areas includes an elongate handle having one free end and an opposite end from which a shank or neck portion integrally depends, said shank and handle defining an aggregate effective lever arm. The article includes a shaving head assembly transversely dependent from said neck portion, the assembly comprising a blade housing including means for holding and positioning of a blade having a length in a range of about 17 to about 23 millimeters, said blade defining a rotated arm of said lever arm in which a ratio of length of said lever arm to said rotated arm defines a range of between about 3.5:1 to about 5.5.1. The preferred length of said blade, within said range, is about 20 millimeters (0.75 inches). The mass or weight of the handle typically exceeds the aggregate mass or weight of the shank and shaving head assembly thereby moving the center of gravity of the article closer to the center of the fingers of the user so that the article may be more easily controlled.

In view of the above, it is an object of the present invention to provide a shaving article particularly adapted for the shaping of mustaches and beards and, additionally, achieving suitable contact, with reduced risk of nicking in difficult to reach and sensitive concave areas of body as is the case when shaving of underarms and bikini areas.

It is another object to provide an article of the above type which, alternatively, may either be permanently integrated into a disposable shaving system or, alternatively, may be furnished as a part of a cartridge shaving system such that only the cartridge portion is disposed of after the blade has become dull.

It is a further object of the invention to provide an article and system of the above type which may be compatibly integrated with state-of-the-art shaving features such as multiple blade cartridges, moisturizing strips, nick guards, and means for blade surface rotation in response to beard or hair density.

It is a yet further object to provide an article and system of the above type which may be cost-effectively produced using state of the art thermoplastic molding methods.

The above and yet other objects and advantages of the present invention will become apparent from the hereinafter-set forth-Brief Description of the Drawings, Detailed Description of the Invention, and Claims appended herewith.

BRIEF DESCRIPTION OF THE DRAWINGS

FIG. 10 is a perspective view showing utility of the invention for shaving in the bikini area.

FIG. 11 is a perspective view showing the use of shaving article in association with trimming and shaping of a beard or mustache.

DETAILED DESCRIPTION OF THE INVENTION

Figure 1:
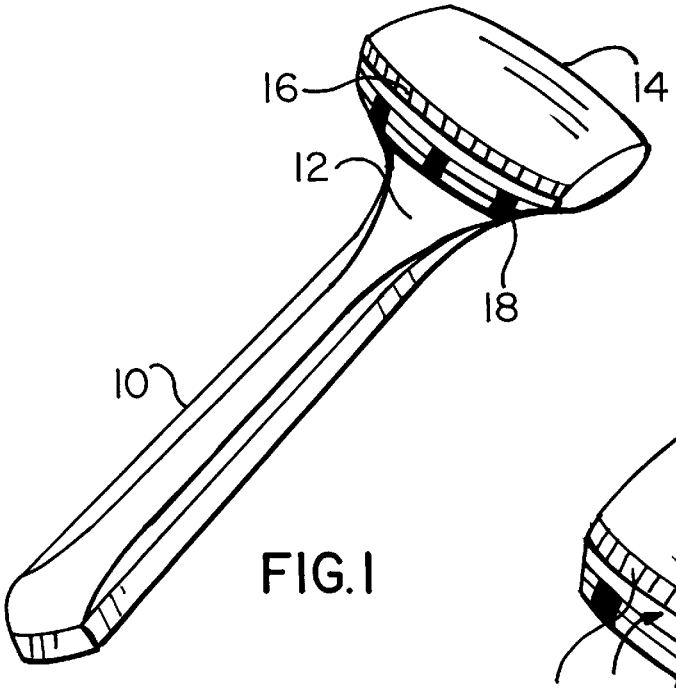
FIG. 1 is a perspective view of the inventive shaving article.
Figure 2:
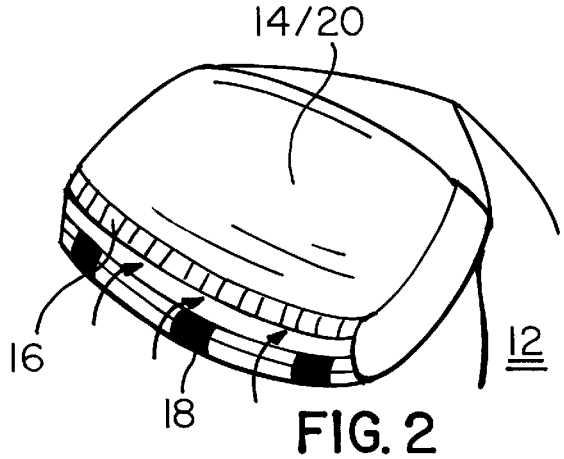
FIG. 2 is an enlarged perspective view of the shaving head assembly thereof.
Figure 3:
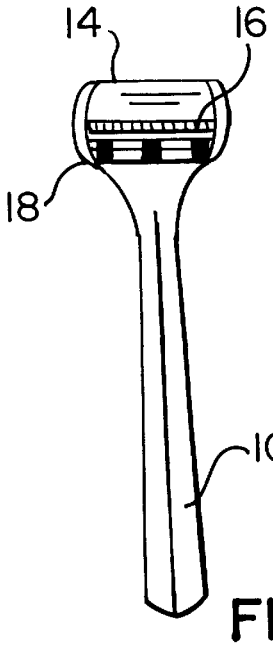
FIG. 3 is a front elevational view of the shaving articles.
Figure 4:
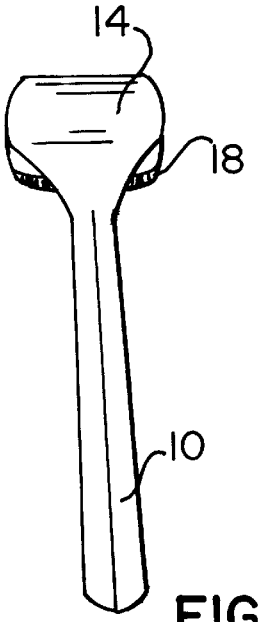
FIG. 4 is a back view thereof.
Figure 5:
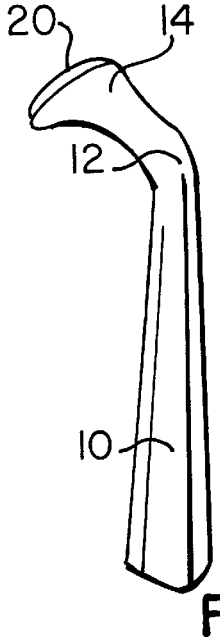
FIG. 5 is a side elevational view thereof.

With reference to the views of FIGS. 1 to 5, the present inventive shaving article, in the disposable embodiment thereof, may be seen to include an elongate handle 10 having a preferred length, inclusive of an integral neck 12, of between about 80 and 100 millimeters (three to four inches).

Transversely dependent from said article neck 12 is a shaving head assembly 14 which, therein, includes means for holding and positioning of a blade 16. In furtherance of the objectives of the invention, said blade must have a longitudinal cutting edge within a range of about 17 to about 23 millimeters, in which 20 millimeters (0.75 inches) comprises a preferred dimension thereof. A typical blade width (if a rectangular blade is used) would be 10 millimeters. In an elongate TRAC type blade, the width would be about 5 millimeters.

Figure 6:
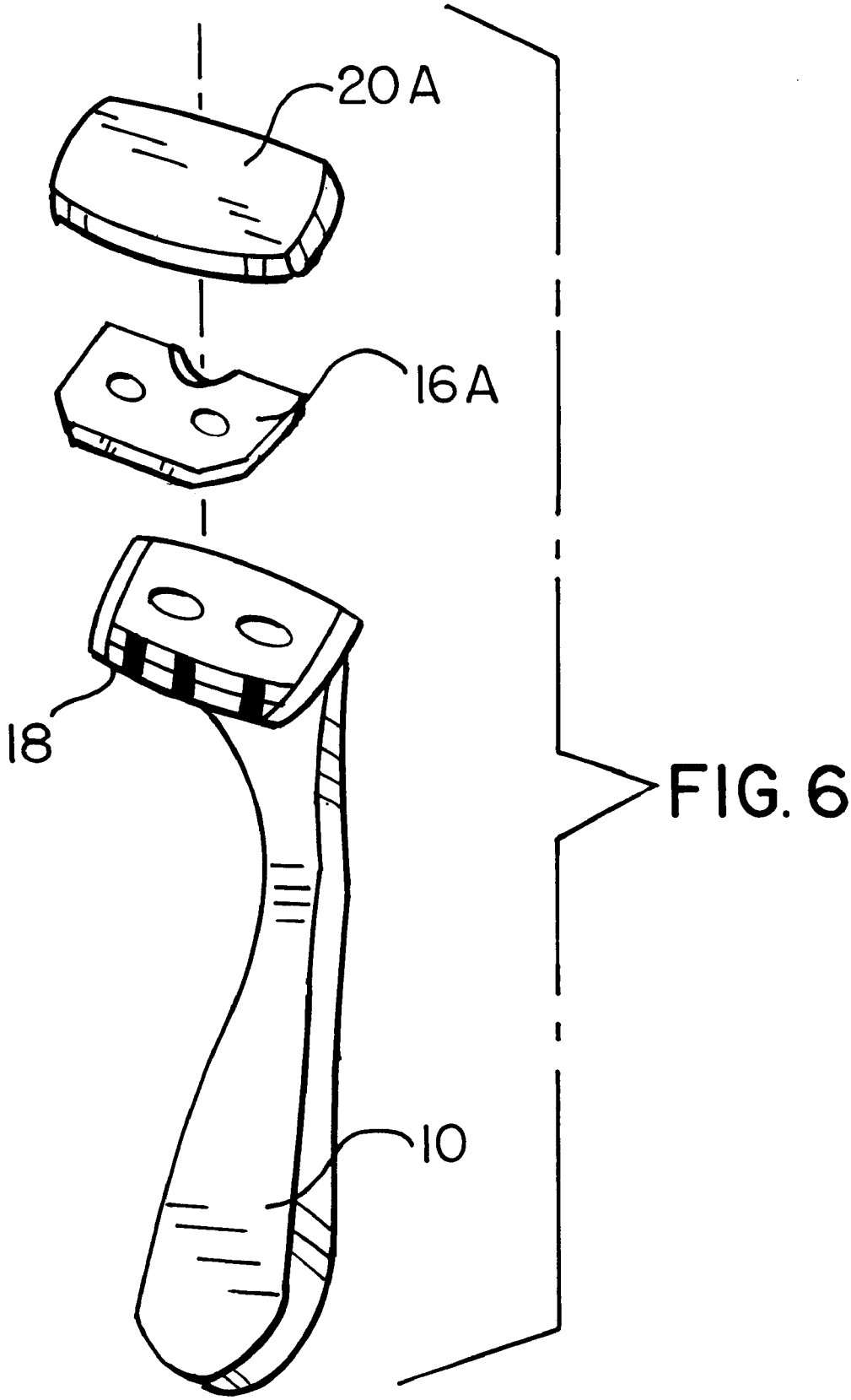
FIG. 6 is an exploded view of a shaving head assembly including a replaceable razor cartridge.

Located forwardly of razor 16 or razor cartridge (in a cartridge embodiment of the invention as is set forth below) is guard bar 18. The positioning of guard bar 18 taken in combination with the geometry of upper surface 20 of shaving head assembly 14 afford some protection to protect the skin against the razor 16. Into guard bar 18 and upper surface 20 may be incorporated any of a number of state-of-the-art safety and comfort features inclusive of a polymeric guard bar which lifts the hair to be cut to increase closeness of the shave, moisturizing means that may be incorporated into the guard bar, and so-called microfoil means that may also be integrated into guard bar 18. Further said rounded geometry to upper surface 20 of the shaving head assembly 14 will reduce the risk of cutting and nicking when the article is used upon a curved body surface. Other state-of-the-art features, such as a pivot connection between the shaving head assembly and the article handle may also be employed within the scope of the instant invention. It is to be appreciated that the embodiments shown in FIGS. 1 to 5 constitute a disposable article while shown in FIG. 6 is a further embodiment in which a replaceable blade cartridge 16A may be employed in combination with a snap-fittable cover 20A to provide a reusable article in which the blade cartridge 16A would be replaced after the blade is dull. Accordingly, the invention may be practiced as either a disposable implement or as one in which only a blade or blade cartridge are periodically disposed.

Figure 7:
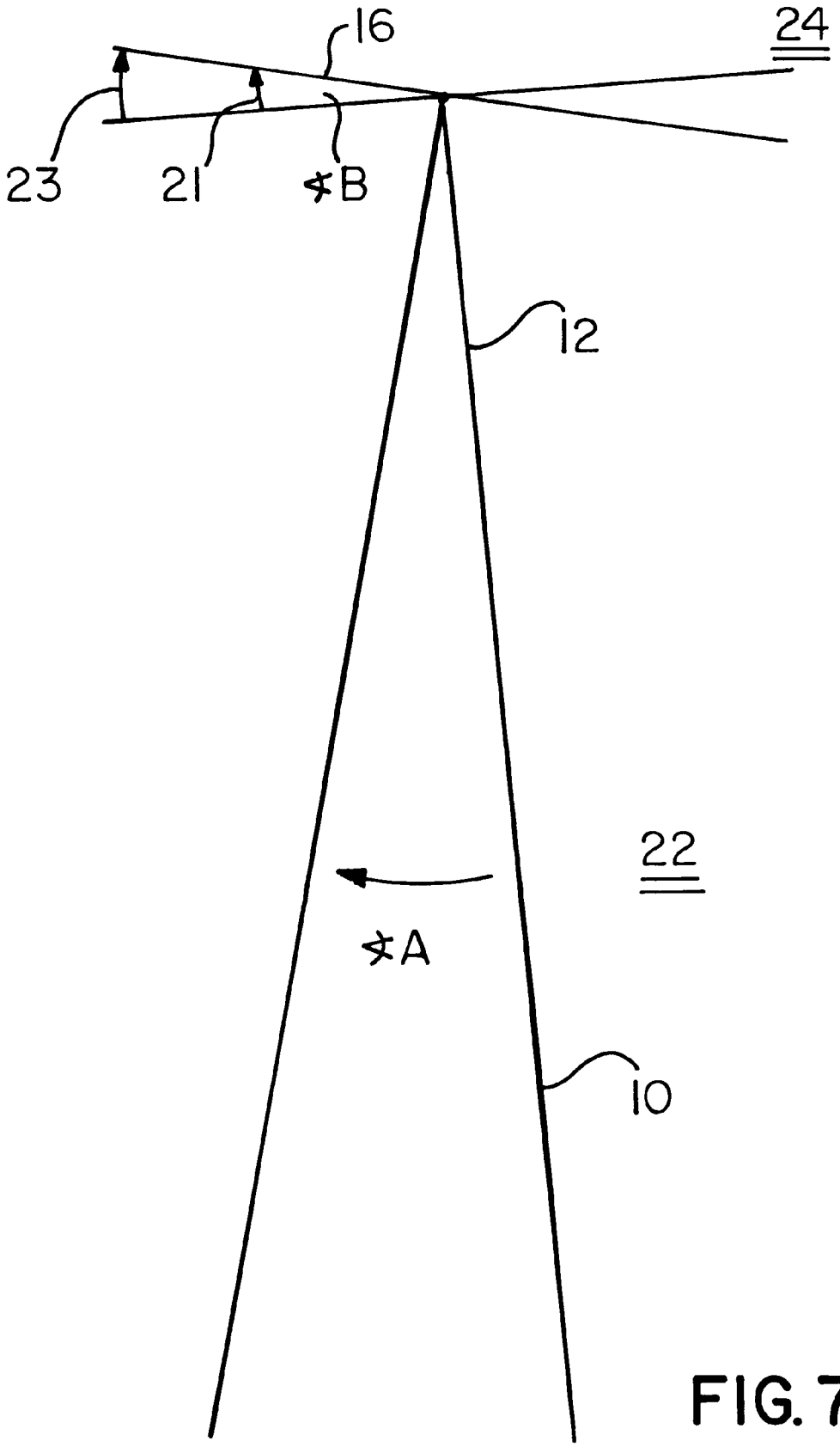
FIG. 7 is a schematic conceptual view of the invention showing the principles of operation thereof.

With reference to FIG. 7, there is illustrated the mechanical basis of the present invention, that is, the benefit in terms of enhanced suitability for use upon sensitive surfaces and curved body areas. More particularly, there is shown in FIG. 7 a lever arm 22 which is defined by the aggregate longitudinal length of handle 10 and neck 12. Further shown is a rotated arm 24 which represents the length of a typical prior art razor, while one-half of the length of 24, i.e., about 20 millimeters, represents the length of the cutting edge razor 16 in the present invention. Accordingly, the arc of rotation responsive to a given degree of rotation A of lever arm 22, in a direction transverse to the direction of cutting, is shown as angle B in FIG. 7. As may be appreciated, inasmuch as the length of the rotated arm 16 of the blade of the invention is about one-half of that of the rotated arm 24 of a prior art razor, the extent of tilt responsive to Angle A of the handle, that is, the sine of angle B, is only one-half that of a prior art razor, i.e., dimension 21 is one-half of dimension 23.

Figure 8:
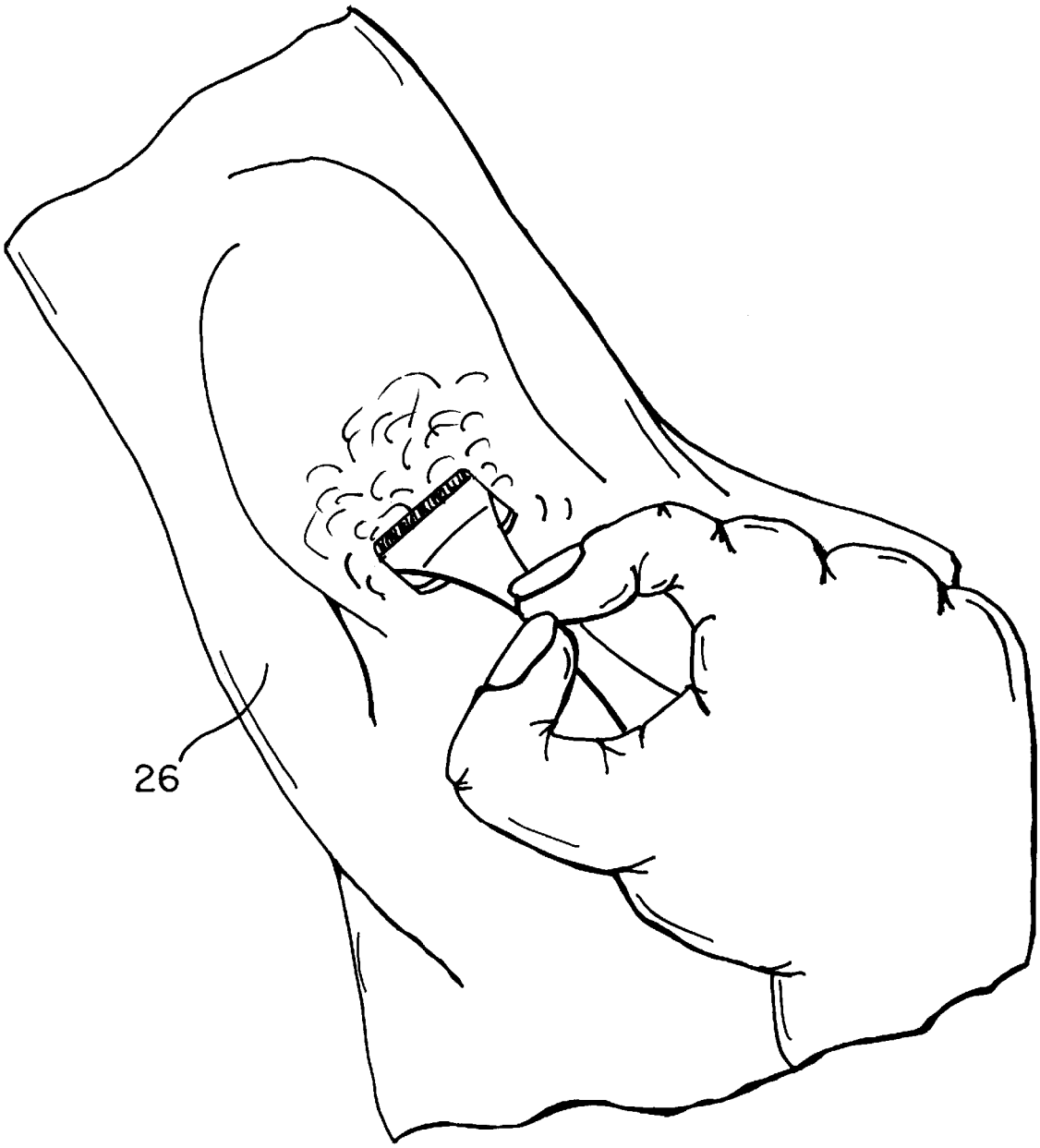
FIG. 8 is an enlarged view showing use of the shaving article in association with the shaving of an underarm area.
Figure 9:
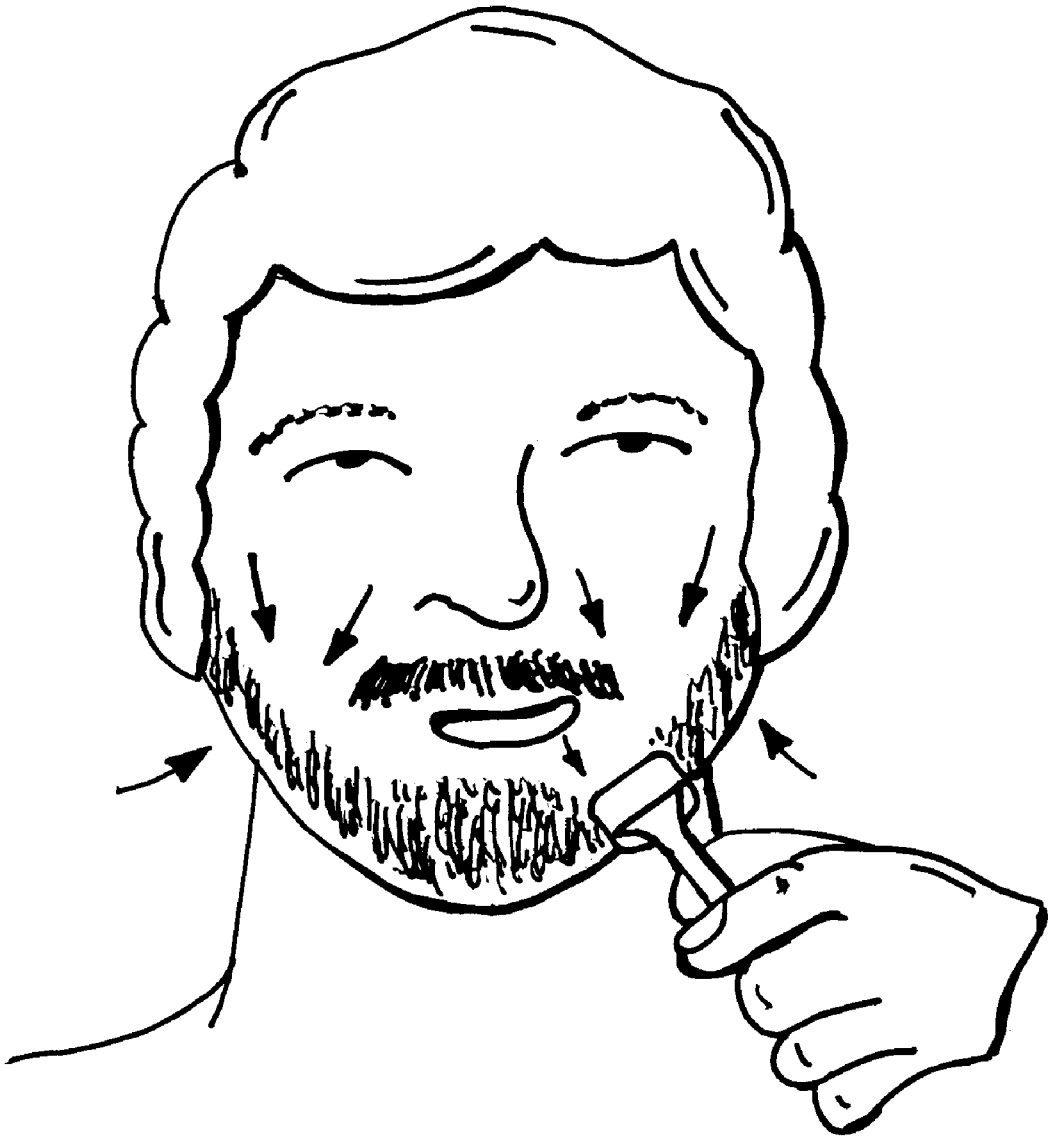
FIG. 9 is a distance perspective view of FIG. 8.

It is to be understood that when using a shaving razor upon a substantially flat or otherwise easy to shave area of the body, it is not often necessary to tilt handle 10. Accordingly, for"normal" shaving, angle A is not a significant factor. However, when the body area of interest is either or both particularly sensitive or curved, as in the case in underarm and bikini areas, as well as certain parts of men's faces, it is necessary to continually position and re-position (transversely tilt) the shaving article handle, thereby giving rise to angle A. This is a particular issue when a tilt or change in position of the razor occurs during a shaving stroke as is inevitable when addressing sensitive, narrow, and curved body areas. When this occurs, the risk of cutting or nicking in prior art devices is approximately twice as great, as is the potential depth of such nicking. In addition, by virtue of merely reducing the length of the blade and thereby the shaving head assembly, it becomes far easier to balance or position the shaving article within underarm areas 26 such as shown in FIGS. 8 and 9 and bikini areas 28 as is shown in FIG. 10. By reason of such reduced length of the shaving head, the incidence of accidental shifting, tilting or movement of the shaving article is reduced yet further adding to the safety aspect of the present invention.

It has been further discovered that a preferred ratio of aggregate handle and neck length to blade length is about 4.5 to 1, this as opposed to the prior art standard ratio of about 2.25 to 1. As a result of increasing the ratio of handle length relative to razor and shaving assembly length, the center of gravity of the entire article is moved toward the center of the handle thereby improving the balance of the resultant article, as is particularly useful in the sensitive areas shown in FIGS. 8 to 10. It is to be further appreciated that the present invention is also most useful to men in shaving environments in which control and sensitivity are major factors. The same is conceptually illustrated in FIG. 11.

It is, finally to be appreciated that the invention may be provided both as a unitary disposable system or with a replaceable blade cartridge and may be provided in the form of the now-popular multi-layer staggered blade configuration.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention, what I claim as new, useful and non-obvious is:

1. A shaving article for sensitive surfaces and curved body areas, the article comprising:

(a) an elongate handle having a free end and an opposite end;

(b) a neck portion integrally dependent, at one end thereof, from said opposite end of said angle, said neck and handle defining, in aggregate, a lever arm; and (c) a shaving head assembly transversely dependent from an opposite end of said neck portion, said assembly comprising a blade housing including means for holding and positioning a razor having a longitudinal dimension in a range of about 17 to about 23 millimeters, in which an upper surface of said shaving head assembly, opposite to a surface dependent from said neck, comprises a curved surface, said shaving head assembly defining a pivot arm relative to said lever arm in which a ratio of length of said lever arm to shaving head pivot arm comprises a range of between about 3.5:1 to about 5.5:1, in which a mass of said handle exceeds an aggregate mass of said neck portion and shaving head assembly, thereby positioning the center of gravity of said article lower than said neck portion and within said handle.

2. A shaving article for sensitive surfaces and curved body areas, the article comprising:

(a) an elongate handle having a free end and an opposite end;

(b) a neck portion, integrally dependent, at one end thereof, from said opposite head of said handle, said neck and handle defining a lever arm having an aggregate length of between about 80 and about 100 millimeters; and (c) a shaving head assembly transversely dependent from an opposite end of said neck portion, said assembly comprising a blade housing including means for holding and positioning a razor having a longitudinal dimension in a range of about 17 to about 23 millimeters, said shaving head assembly defining a pivot arm relative to said lever arm in which a ratio of length of said lever arm to shaving head pivot arm comprises a range of between about 3.5:1 to about 5.5:1, in which a mass of said handle exceeds an aggregate mass of said neck portion and shaving head assembly, thereby positioning the center of gravity of said article lower than said neck portion and within said handle.

3. The article as recited in claim 2, in which a preferred ratio of said lever to rotated arm is about 4.5 to 1.

4. The article as recited in claim 2, in which a preferred length of said razor is about 20 millimeters.

5. The article as recited in claim 2, in which an upper surface of said shaving head assembly, opposite to a surface dependent from said neck, comprises a curved surface.

6. The article as recited in claim 2, in which said razor comprises a double-sided blade.

7. The article as recited in claim 2, in which said razor comprises stacked multiple staggered blades.

8. The article as recited in claim 2, in which said razor comprises a replaceable cartridge element for holding said razor.

9. The article as recited in claim 1, in which a preferred ratio of said lever to rotated arm is about 4.5 to 1.

10. The article as recited in claim 1, in which a preferred length of said razor is about 20 millimeters.

11. The article as recited in claim 1, in which said razor comprises a double-sided blade.

12. The article as recited in claim 1, which said razor comprises stacked multiple staggered blades.

13. The article as recited in claim 1, said razor comprises a replaceable cartridge element for holding said razor.

* * * * *